US005930871A

United States Patent [19]

Raja

[11] Patent Number: 5,930,871

[45] Date of Patent: Aug. 3, 1999

[54] AIR DOFFING SYSTEM FOR A TEXTILE PROCESSING MACHINE

[75] Inventor: Maq E. Raja, Simpsonville, S.C.

[73] Assignee: John D. Hollingsworth on Wheels, Inc., Greenville, S.C.

[21] Appl. No.: 09/112,552

[22] Filed: Jul. 9, 1998

[51] Int. Cl.[6] ..... D01G 15/46; D01G 25/00

[52] U.S. Cl. ..... 19/296; 19/106 R; 19/304

[58] Field of Search ..... 19/106 R, 107, 19/98, 99, 112, 115 B, 303, 296, 65 A, 262, 263, 203, 304, 308; 492/28, 30

[56] References Cited

U.S. PATENT DOCUMENTS

| | | | |
|---|---|---|---|
| 3,256,569 | 6/1966 | Draver | 19/156.4 |
| 3,483,598 | 12/1969 | Bryan | 72/53 |
| 3,787,930 | 1/1974 | Allen | 19/308 |
| 3,867,741 | 2/1975 | Frolov et al. | 19/106 R |
| 3,992,755 | 11/1976 | Bonalumi | 19/106 R |
| 3,999,250 | 12/1976 | Brown et al. | 19/106 |
| 4,475,271 | 10/1984 | Lovgren et al. | 19/105 |
| 4,599,766 | 7/1986 | Wirth | 19/106 R |
| 4,706,338 | 11/1987 | Anspach | 19/105 |
| 4,807,480 | 2/1989 | O'Neill et al. | 73/28 |
| 4,884,320 | 12/1989 | Gasser et al. | 19/106 R |
| 4,967,946 | 11/1990 | Gasser et al. | 19/263 |
| 5,007,137 | 4/1991 | Graute | 19/296 |
| 5,289,618 | 3/1994 | Fehrer | 19/304 |
| 5,365,762 | 11/1994 | Thompson | 72/53 |
| 5,517,726 | 5/1996 | Beier | 19/296 |
| 5,584,101 | 12/1996 | Brabant et al. | 19/304 |
| 5,636,411 | 6/1997 | Greis et al. | 19/157 |

FOREIGN PATENT DOCUMENTS

| | | |
|---|---|---|
| 4126625 | 8/1991 | Germany . |
| 5-239721 | 9/1993 | Japan . |

*Primary Examiner*—John J. Calvert
*Assistant Examiner*—Tejash D Patel
*Attorney, Agent, or Firm*—Leatherwood Walker Todd & Mann, P.C.

[57] ABSTRACT

An air doffing system for a fiber-processing machine which includes an air plenum associated with a carding roll. A doffing blade initiates lifting of fibers from a carding roll, and a laminar airflow pulls the fibers through the plenum. The airflow is pulled through a perforated roll on the opposite end of the plenum. The perforated roll operates in connection with a smooth roll to form a roller pair which work the fibers collected on the perforated into a web. The web is then formed into a sliver by a trumpet and a calendar roll pair.

17 Claims, 2 Drawing Sheets

AIR DOFFING SYSTEM FOR A TEXTILE PROCESSING MACHINE

BACKGROUND OF THE INVENTION

This invention relates generally to a system for air doffing a fibrous web from the working cylinder of a textile fiber-processing machine, such as a textile-carding machine.

A typical textile-carding machine includes a feed roll to which a mass of fibers are fed. The feed roll transfers the fibers to a lickerin roll, which then transfers the fibers to the carding roll. The carding roll is the primary fiber working member in the carding machine and serves to form the mass of fibers being worked into a relatively thin, sheet-like configuration known as a web. The web is subsequently physically removed from the carding roll with a doffer roll and is condensed into a rope-like configuration known as sliver. The sliver is then typically further worked and ultimately is formed into yarn by a spinning machine.

The present invention is drawn to the removal, "doffing," of the web from the carding roll and formation of the removed web into a sliver.

Various doffing and carding machine devices are known. U.S. Pat. No. 4,475,271, issued to Lovgren, et al, and U.S. Pat. No. 4,706,338, issued to Anspach, discuss the doffing of a rotating carding cylinder by means of an air stream. U.S. Pat. No. 3,256,569, issued to Draving, discloses air doffing between a carding cylinder and a perforated condensing cylinder.

U.S. Pat. No. 4,599,766, issued to Wirth, discloses use of a perforated housing for removing microdust in fiber being doffed from a cylinder by a doffing cylinder 4. U.S. Pat. No. 4,884,320, issued to Gasser, et al, shows use of a trough in connection with a take-off roller.

While the foregoing designs are known, there still exists a need for an air doffing system which will remove a fiber web from a carding roll and assist in the formation of the web into a sliver.

SUMMARY OF THE INVENTION

It is, therefore, the principal object of this invention to provide an air doffing system which does not require use of a doffing roll for removing fiber from a carding roll.

Another object of the present invention is to provide an air doffing system having monitors for allowing the mass flow of fibers doffed from the carding roll to be selectively varied.

Still another object of the present invention is to provide an air doffing system which removes trash and microdust from the fibers during doffing.

Generally, the present invention includes an air doffing system for a fiber-processing machine. The system includes an air plenum, or suction duct, having an inlet end and an outlet end. The inlet end is in close proximity to a carding roll of a textile fiber processing machine, such as a carding machine, cleaning machine, fiber recycling machine, etc. A suction pump, such as a fan, blower, pump, or some other conventional device is used for drawing a vacuum within the suction plenum sufficient to remove fibers from the carding roll and to transport them from the inlet end of the suction plenum to the outlet end. Disposed between such suction means and the outlet of the suction plenum is a fiber condensing system, which includes a press roll, preferably having smooth surface, which is used in combination with a fiber collection roll, preferably having a perforated surface. The rolls are in close proximity to one another such that a nip zone is formed therebetween. The press roll in combination with the perforated roll receive the fibers drawn through the suction plenum, and by virtue of the fibers adhering to the surface of the perforated roll, and through use of a doctor or "offer" blade, the fibers collect on the perforated roll are formed into a web which is propelled from the outlet area of the suction plenum through the nip zone between the press roll and the perforated roll. A sliver trumpet, or condenser, is positioned downstream of the web and serves to condense the web into a sliver. Downstream from the condenser is a pair of calendar rolls which serves to compress the sliver and to make the sliver more coherent.

The present invention also includes a filtration system for use in connection with the suction means which serves to filter dirt and debris which may be entrained in the suction airflow pulled through the suction plenum. This performs a further cleaning of the fibers as the fibers leave the carding roll.

Additionally, the suction plenum is provided with a mass flow sensor which monitors the mass flow of fibers through the plenum, and also a choke sensor for sensing a clog or choke in the suction plenum, should one arise. The mass flow sensor is connected to the fiber feed control, and more specifically, to the control for the feed roll of the textile machine, such as a carding machine, such that should the mass flow of fibers through the suction plenum become too great, the feed roll speed can be slowed in order to reduce the amount of fibers being presented to the carding roll. Likewise, the choke sensor is connected to the feed roll control such that in the event of a choke, the feed roll is disabled so that no further fibers are presented to the carding roll. Finally, the mass flow rate in the choke sensor may be in communication with one another to better monitor fiber flow and stoppage within the suction plenum.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
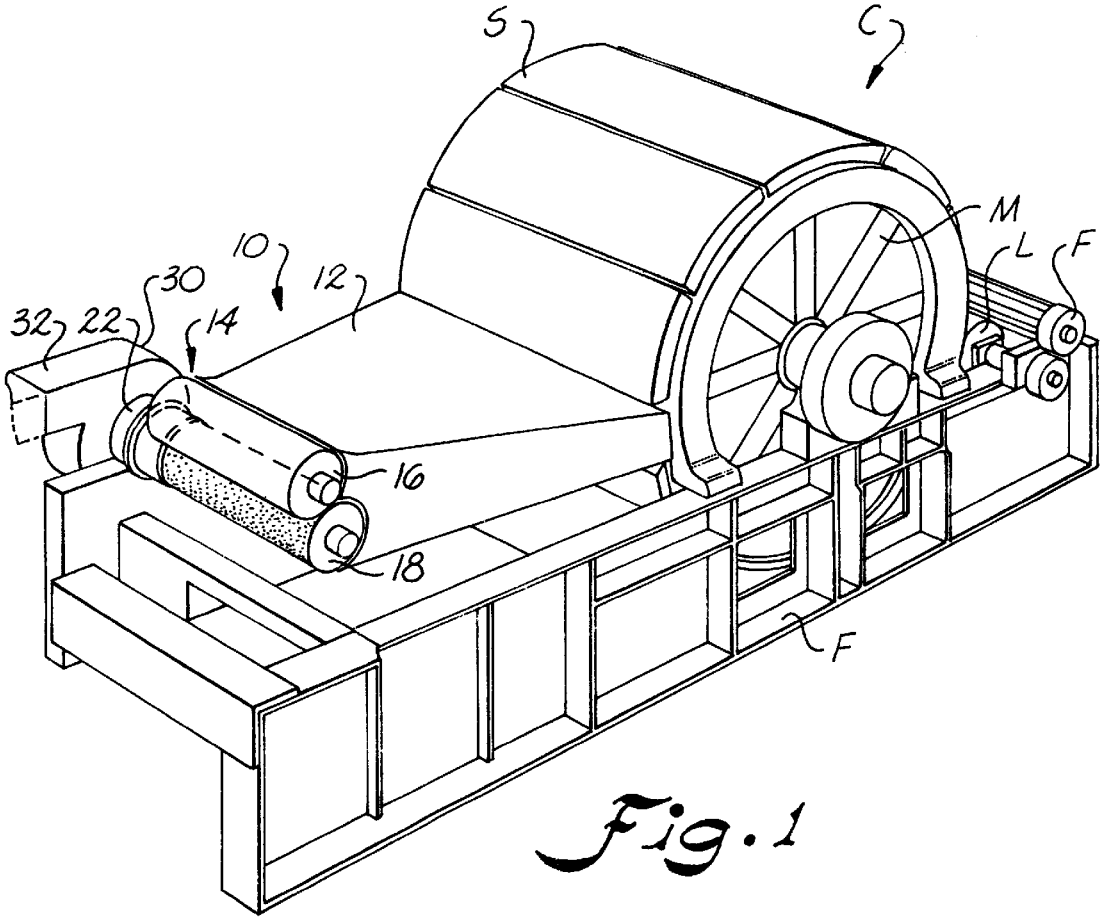
FIG. 1 is a perspective view of a carding machine having an air doffing system constructed in accordance with the present invention.

The accompanying drawings and the description which follows set forth this invention in its preferred embodiment. However, it is contemplated that persons generally familiar with textile machinery will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the air doffing system of the present invention is indicated generally in the figures by reference character 10.

Turning to FIG. 1, a textile fiber machine, and more specifically, a carding machine C is illustrated. The carding machine C may be of conventional design and includes a feed roll F, a lickerin roll L, a main carding cylinder, or roll, M, which works in conjunction with stationery carding segments S. Rolls F, L and M are supported for rotation within a frame R and are powered by conventional drive means, such as an electric motor (not shown).

The air doffing system 10 of the present invention includes a suction plenum, generally 12, a roll pair, generally 14, which includes a press roll 16 and a perforated roll 18. Roll pair 14 includes a nip zone, generally 20 formed between rolls 16 and 18.

A duct 22 connects the interior 24 of perforated roll to the intake 28 of a blower 30. Blower 30 also includes an exhaust portion 32 through which air drawn through perforated roll 24 is exhausted. A conduit 36 (FIG. 3) may be connected to exhaust 32 of blower 30 to draw the exhaust from blower 30 to some other desired location.

Suction plenum 12 includes an inlet end 38 an outlet end 39 opposite thereto. Suction drawn through interior portion 24 of perforated roll 18 also serves to draw suction through substantially the entirety of suction plenum 12. Preferably, suction plenum 12 is maintained at negative pressure of approximately negative 10 to 18 inches Hg, although this negative pressure can vary depending upon the particular application.

Figure 2:
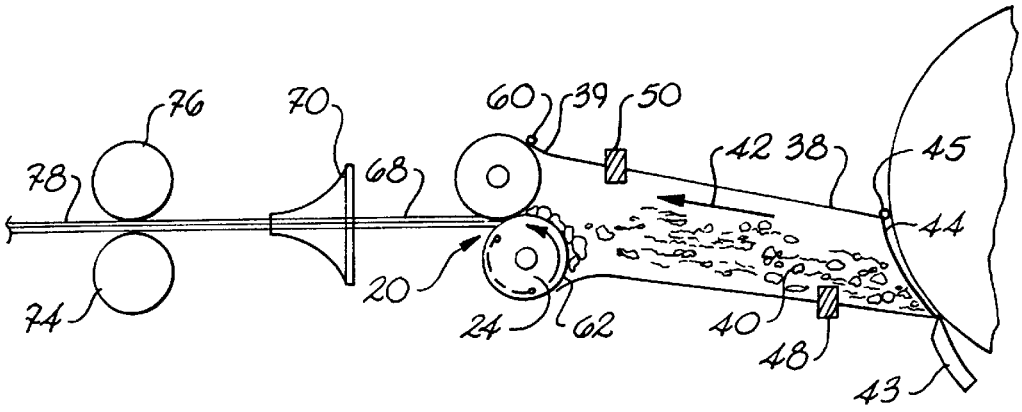
FIG. 2 is a sectional view of an air doffing system constructed in accordance with the present invention.

Turning now to FIG. 2, a sectional view of the air doffing system 10 of the present invention is illustrated. Fibers, generally 40, are drawn from the surface of a carding roll M through suction plenum 12 in the direction of arrow 42. A doffer blade 43 is used to lift the fibers from the surface of carding roll M. It is to be understood that up to this point, carding machine C can be of conventional design and can operate in conventional fashion in the process of aligning fibers, with those fibers being carried about the surface of the main carding cylinder M.

Inlet end 38 of suction plenum 12 extends the width of main carding cylinder M and has a curved entry profile 44 corresponding to the peripheral surface of the carding cylinder such that there is a close fit between the inlet end of plenum 12 and the peripheral surface of carding roll M.

Flexible seals, generally 45, such as rubber, plastic, or brush strips could be provided along the upper edge, side edges, and also the lower edge, if desired, in order to decrease leakage of air into suction plenum 12 around the edges of entry profile 44 of inlet 38 in an uncontrolled fashion. Further, vents, generally 46 (FIG. 3) could also be provided in the upper, and/or lower portions of inlet 38 in order to control airflow directions and velocities through plenum 12.

An important feature of the present invention is the provision of laminar instead of turbulent airflow in the plenum 12. Accordingly, sizing and construction of plenum 12, perforated roll 18, suction fan, or blower, 30, and the remaining portions of system 10 through which air is drawn are preferably such that laminar flow is established and maintained in plenum 12.

A choke sensor 48, which can be of conventional design, is provided to sense the clogging or choking of plenum. Also, a mass flow sensor 50, which could also be of conventional design, is provided in plenum 12 to sense the mass flow of fibers therethrough. Preferably, mass flow sensor 50 is connected to a feed roll control 52 (FIG. 4) and provides feedback to the feed roll control such that if the mass flow through plenum 12 is too great, the feed roll drive control 52 will be instructed to slow down (thereby presenting less fibers to the main carding roll), and if the mass flow rate is too low within plenum 12, the feed roll drive control 52 will be instructed to speed up (which would present more fibers to the main carding roll M).

Figure 4:
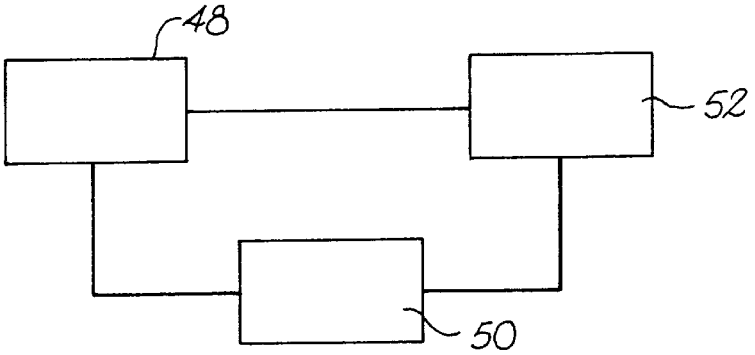
FIG. 4 is a schematic view of a choke sensor, a mass flow sensor, and a feed roll drive control constructed in accordance with the present invention.

Preferably, the choke sensor 48 is also connected to feed roll control 52 such that if a clogged or choked condition is sensed, the feed roll will automatically be stopped. Finally, as illustrated in FIG. 4, the choke sensor could be in communication with the mass flow sensor, such that if the mass flow of fibers drops significantly, this could be an indication of a choked condition.

Perforated roll 18 has a peripheral surface which is foramus, and is preferably metal with perforations provided therein. It is to be understood, however, other materials could also be used, such as plastic, or some durable fabric material, such as Kevlar®.

Roll 18 is driven by a motor 53 and cooperates with the smooth surface press roll 16, also driven by motor 53 through belt 54. It is to be understood that rolls 16 and 18 could be driven separately, or could be driven the same motor, through use of a belt, chain, toothed belt, etc.

Figure 3:
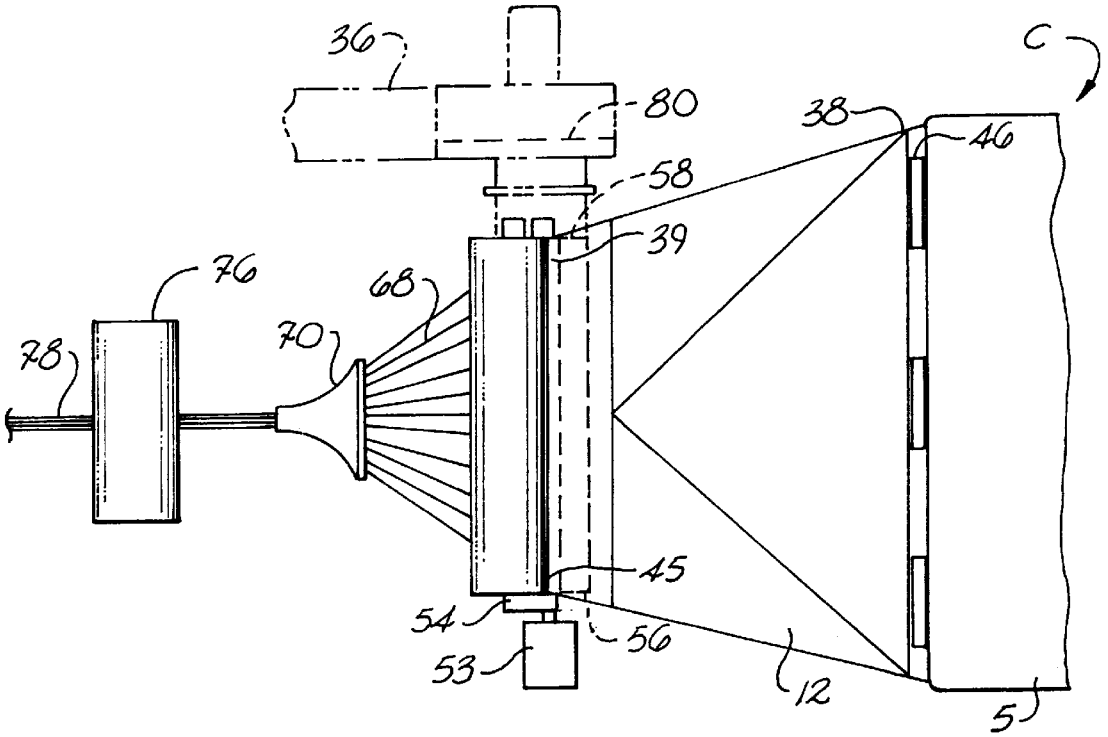
FIG. 3 is a plan view of an air doffing system constructed in accordance with the present invention.

As shown in FIG. 3, one end 56 of roll 18 is closed, where the other end 58 is in open communication with duct 22, such that suction drawn through duct 22 produces negative pressure within the interior of perforated roll 18. Preferably, sealing means 60, such as rubber or plastic strips, or brushes, or the like are provided around the edges of outlet 38 of duct 12 to prevent leakage of outside air into outlet end 38, the purpose being to maintain a negative pressure in duct 12 as the fibers are being drawn from main cylinder M to perforated roll 18.

As the vacuum device (or suction fan), such as blower 30, pulls air through plenum 12, the fibers, which are lifted from main cylinder M through use of doffer blade 43, are propelled under a laminar suction air flow and collected on the peripheral surface 62 of roll 18. The fibers are held in place on the perforated surface 62 by virtue of the negative pressure of the vacuum being drawn through roll 18. A second doffer blade (not shown) may be provided for removing fibers from roll 18 at the nip zone 20 such that such fibers form a web 68. The web 68 is then pulled through a sliver trumpet, or condenser 70, by a downstream calendar roll pair 72 consisting of conventional calendar rolls 74, 76. Calendar rolls 74, 76 are driven independently of press roll 16 and perforated roll 18, such that the rotation of the respective roll pairs 16, 18 and 74, 76 can be varied with respect to one another, thereby giving more control to the doffing operation. As the web passes through condenser 70, it is formed into a sliver 78. Condenser 70 and calendar roll pair 72 can be of conventional design.

Preferably, a filter 80, which can be of conventional design is provided on the inlet end of a blower 30, such that air pulled through perforated roll interior 24, and any debris such as "micro dust" is filtered from the air stream prior to entry of the air into blower 30. This allows for enhanced cleaning of fibers 42 as such fibers are doffed from cylinder M and formed into sliver 78.

Although not shown, it is anticipated that a stream of high-pressure air could be used instead of a doffer blade 43 to lift fibers from roll M.

Thus, the present invention provides an air doffing system which allows for elimination of a conventional doffing roll, and could potentially find application on textile processing machines such the carding machine illustrated herein, or in fiber recycling machines, cleaning machines, or other textile machines having fiber working rolls.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A doffing system for a textile processing machine, wherein the textile fiber processing machine includes a carding roll for carding fibers, the doffing system comprising:

an enclosed suction plenum having an inlet end and an outlet end opposite said inlet end, said inlet end being adjacent to the carding roll;

a perforated roll carried for rotation adjacent the outlet end of said plenum, said perforated roll having a perforated surface and defining a chamber in fluid communication with said perforated surface;

a press roll carried adjacent to said outlet of said plenum and adjacent to said perforated roll such that a nip zone is formed between said press roll and said perforated roll; and a suction fan for providing a suction-air flow for suctioning fibers off of the carding roll, said suction fan being connected to said chamber of said perforated roll and configured to draw said suction air flow through each of said chamber, said perforated surface, and said suction plenum for suctioning fibers off of the carding roll and for transporting the fibers to said perforated roll for collection on said perforated surface.

2. The doffing system as defined in claim 1, further comprising an elongated doffer blade carried adjacent the carding roll for lifting fibers from the carding roll.

3. The doffing system as defined in claim 1, further comprising a motor for driving both said press roll and said perforated roll.

4. The doffing system as defined in claim 1, further comprising a condenser downstream of said press roll and perforated roll for condensing fibers delivered from said press roll and said perforated roll.

5. The doffing system as defined in claim 4, further comprising a calendar roll pair forming a nip zone therebetween for engaging and pulling the sliver through said condenser.

6. The doffing system as defined in claim 1, further comprising a choke sensor for detecting fiber clogs within said suction plenum.

7. The doffing system as defined in claim 1, further comprising a mass flow sensor for sensing a mass flow of fibers in said suction plenum.

8. The doffing system as defined in claim 1, further comprising a doffing blade associated with said perforated roll for lifting and removing fibers from said surface of said perforated roll.

9. The doffing system as defined in claim 1, further comprising a feed roll for feeding fibers to the carding roll and a feed roll control for controlling the rotation of said speed roll.

10. The doffing system as defined in claim 9, further comprising a mass flow sensor for sensing a mass flow of fibers in said suction plenum, and wherein said mass flow sensor is connected to said feed roll control for influencing the rotational speed of the feed roll.

11. The doffing system as defined in claim 9, further comprising a choke sensor for detecting fiber clogs within said suction plenum and wherein said choke sensor is connected to the feed roll control for influencing rotation of the feed roll if a clog is sensed within the suction plenum.

12. A method of doffing fibers from a carding roll, comprising:

providing an enclosed suction plenum adjacent the carding roll;

providing a perforated roll adjacent said suction plenum; and drawing a suction air flow through said plenum and through said perforated roll such that fibers are suctioned off of the carding roll by said suction air flow and such that said suction air flow transports the fibers suctioned off of the carding roll through said suction plenum and causes the fibers to collect on the surface of said perforated roll.

13. The method as defined in claim 12, further comprising:

providing a press roll adjacent to said perforated roll such that a nip zone is formed therebetween; and forming a web from the fibers collected on the surface of said perforated roll.

14. The method as defined in claim 12, wherein the drawing of air includes drawing of the air such that a laminar flow is established in said suction plenum.

15. A method of producing sliver from fibers on a carding roll, the method comprising:

providing an enclosed suction plenum adjacent the carding roll;

providing a perforated roll adjacent said suction plenum;

providing a press roll adjacent said perforated roll such that a nip zone is formed therebetween;

drawing a suction air flow through said plenum and through said perforated roll such that fibers are suctioned off of the carding roll by said suction air flow and such that said suction air flow transports the fibers suctioned off of the carding roll through said suction plenum and causes the fibers to collect on the surface of said perforated roll and such that the fibers are formed into a web at said nip zone;

providing a condenser downstream of said nip zone; and condensing said web into a sliver with said condenser.

16. The method as defined in claim 15, further comprising providing a pair of calendar rolls down stream of said condenser for engaging and pulling said sliver through said condenser.

17. A doffing system for a textile processing machine, wherein the textile fiber processing machine includes a fiber working roll and a driven feed roll for delivering fibers to the fiber working roll, the doffing system comprising:

an elongated, enclosed plenum for carrying fibers, said plenum having a first end and a second end opposite said first end, said first end defining an elongated doffing opening for placement adjacent the fiber working roll and for receiving fibers therefrom, and said second end of said plenum defining a delivery opening;

a roll pair carried for rotation adjacent said delivery opening of said plenum, said roll pair including a fiber collection roll having a perforated surface, and said roll pair forming a nip zone for receipt of fibers from said delivery opening;

a motor connected to at least one roll of said roll pair for rotating said at least one roll; and a suction fan associated with said plenum and connected to said fiber collection roll, said suction fan providing a suction air flow for suctioning fibers off of the fiber working roll, and said suction air flow transporting fibers suctioned of the working roll through said plenum and transporting air through said fiber collection roll such that the fibers are pulled through said plenum and are sucked onto said perforated surface.

* * * * *